US006808856B2

(12) United States Patent
Fukuda et al.

(10) Patent No.: US 6,808,856 B2
(45) Date of Patent: Oct. 26, 2004

(54) LIQUID DEVELOPER, METHOD FOR MANUFACTURE THEREOF, IMAGE FORMING DEVICE, AND IMAGE FORMING METHOD

(75) Inventors: Makoto Fukuda, Kawasaki (JP); Toru Takahashi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 74 days.

(21) Appl. No.: 10/265,793

(22) Filed: Oct. 8, 2002

(65) Prior Publication Data

US 2003/0143477 A1 Jul. 31, 2003

(30) Foreign Application Priority Data

Jan. 18, 2002 (JP) ..... 2002-010374

(51) Int. Cl.[7] ..... G03G 9/135
(52) U.S. Cl. ..... 430/115
(58) Field of Search ..... 430/115

(56) References Cited

U.S. PATENT DOCUMENTS

| | | | |
|---|---|---|---|
| 5,609,979 A | 3/1997 | Lawson | 430/109 |
| 6,174,640 B1 | 1/2001 | Lawson | 430/115 |
| 6,287,741 B1 | 9/2001 | Marko | 430/115 |
| 6,620,569 B2 * | 9/2003 | Tsubuko et al. | 430/115 |

FOREIGN PATENT DOCUMENTS

| | | |
|---|---|---|
| JP | 55-83057 | 6/1980 |
| JP | 60-11853 | 1/1985 |
| JP | 3-33753 | 2/1991 |
| JP | 5-158287 | 6/1993 |

OTHER PUBLICATIONS

EPIKOTE 1001 Data Sheet (2 pages).
CIBA Resins Coating Systems brochure relating to Araldite Epoxy Resins (cover page and pp. 7 & 8) dated Jun. 1995.

* cited by examiner

*Primary Examiner*—Mark A. Chapman
(74) *Attorney, Agent, or Firm*—Armstrong, Kratz, Quintos, Hanson & Brooks, LLP

(57) ABSTRACT

A liquid developer and the like which have good storage stability and can enable formation of high-quality images stably over a long period of time. The liquid developer of the present invention comprises: an insulating carrier liquid; toner particles insoluble in the insulating carrier liquid, and containing a colorant and a binder resin; and at least one of a silane coupling agent and an alkoxy-modified silicone. The silane coupling agent has at least one functional group selected from amino groups, methacryloxy groups, epoxy groups, isocyanate groups, mercapto groups, and vinyl groups.

13 Claims, 1 Drawing Sheet

LIQUID DEVELOPER, METHOD FOR MANUFACTURE THEREOF, IMAGE FORMING DEVICE, AND IMAGE FORMING METHOD

BACKGROUND OF THE INVENTION

1. Field of the Invention

The present invention relates to a liquid developer used in image forming devices such as electrophotographic or electrostatic recording copiers, facsimile devices, printers, printing machines, printed wiring board fabricating devices, photomask fabricating devices, and the like, and to a method for manufacturing the liquid developer.

2. Description of the Related Art

Conventional electrophotographic methods generally utilize a photoconductive insulator, as disclosed in U.S. Pat. No. 2,297,691. In such a method, an electrostatic latent image is formed, by irradiating light, on a photoconductive insulator (an electrostatic latent image carrier) which has been charged by a corona or rollers or the like. An image is obtained by developing the electrostatic latent image by electrostatically adhering thereto resin particles which are colored by a pigment or dye (such resin particles are called a toner). After the obtained image is transferred onto paper or a film, it is fused (fixed) by heat, pressure, light, or the like such that a visible image is obtained.

Electrophotographic methods can broadly be classified into dry developing methods and wet developing methods (liquid developing methods). In a dry developing method, toner particles alone are used as the developer, or a mixture of toner and magnetic particles called a carrier is used as the developer. In either case, the developer is used in the form of a powder. The wet developing method utilizes a liquid developer in which toner is dispersed within a liquid which is a carrier.

In order to more faithfully reproduce the electrostatic latent image formed on the photoconductive insulator and to output a more detailed image, it is preferable for the particle diameter of the toner particles to be smaller. However, with the dry developing method, if the particle diameter is small, the interior of the device becomes dirty, handling of the developer is difficult, and the developer is harmful in that it is easy for persons to inhale such small-sized toner particles. Accordingly, in a dry developing method, use of a toner having a particle diameter of about 5 $\mu$m or less is unrealistic. On the other hand, in a wet developing method, the toner particles exist within a liquid. Thus, even if toner particles of a particle diameter of about 5 $\mu$m or less are used, the aforementioned problems do not arise, and there is the advantage that highly-detailed images can be obtained.

Generally, in a liquid developer used for electrophotography, toner particles, whose main components are a binder resin and a colorant such as carbon black, an organic pigment, a dye or the like, are dispersed in a carrier liquid, whose main component is a substance having good insulating performance and a low dielectric constant such as a petroleum-based aliphatic hydrocarbon or silicone oil. In addition, a charge adjusting agent for imparting an appropriate charge to the toner particles is added into the carrier liquid, and additives for improving the dispersion stability of the toner particles are added into the carrier liquid. Initially, good printing characteristics can be obtained by using a liquid developer prepared from these components. However, there is the problem that, with regard to re-dispersability, the storage environment, deterioration in the printing characteristics accompanying a rise in temperature within the printing device, and the like, sufficient effects are not obtained.

SUMMARY OF THE INVENTION

An object of the present invention is to provide a liquid developer which has excellent storage stability and which can enable stable formation of high-quality images over a long period of time, and to provide an effective method for manufacturing the liquid developer, as well as an image forming device and image forming method.

A liquid developer of the present invention comprises: an insulating carrier liquid; toner particles containing a colorant and a binder resin, and insoluble in the insulating carrier liquid; and at least one selected from alkoxy-modified silicone, and silane coupling agents having at least one functional group selected from amino groups, methacryloxy groups, epoxy groups, isocyanate groups, mercapto groups, and vinyl groups.

A method for manufacturing a liquid developer of the present invention comprises the step for compounding: an insulating carrier liquid; toner particles containing a colorant and a binder resin, and insoluble in the insulating carrier liquid; and at least one selected from alkoxy-modified silicone, and silane coupling agents having at least one functional group selected from amino groups, methacryloxy groups, epoxy groups, isocyanate groups, mercapto groups, and vinyl groups.

An image forming method for the present invention comprises: a step for forming an electrostatic latent image on an electrostatic latent image carrier; a step for developing the electrostatic latent image with the liquid developer of the present invention, and forming a visible image; and a step for transferring the visible image onto a transfer material.

An image forming device of the present invention comprises: an electrostatic latent image carrier; means for forming an electrostatic latent image on the electrostatic latent image carrier; means for developing the electrostatic latent image, forming a visible image, and which accommodates the liquid developer of the present invention; and means for transferring the visible image onto a transfer material.

DESCRIPTION OF THE PREFERRED EMBODIMENTS

Liquid Developer

Figure 1:
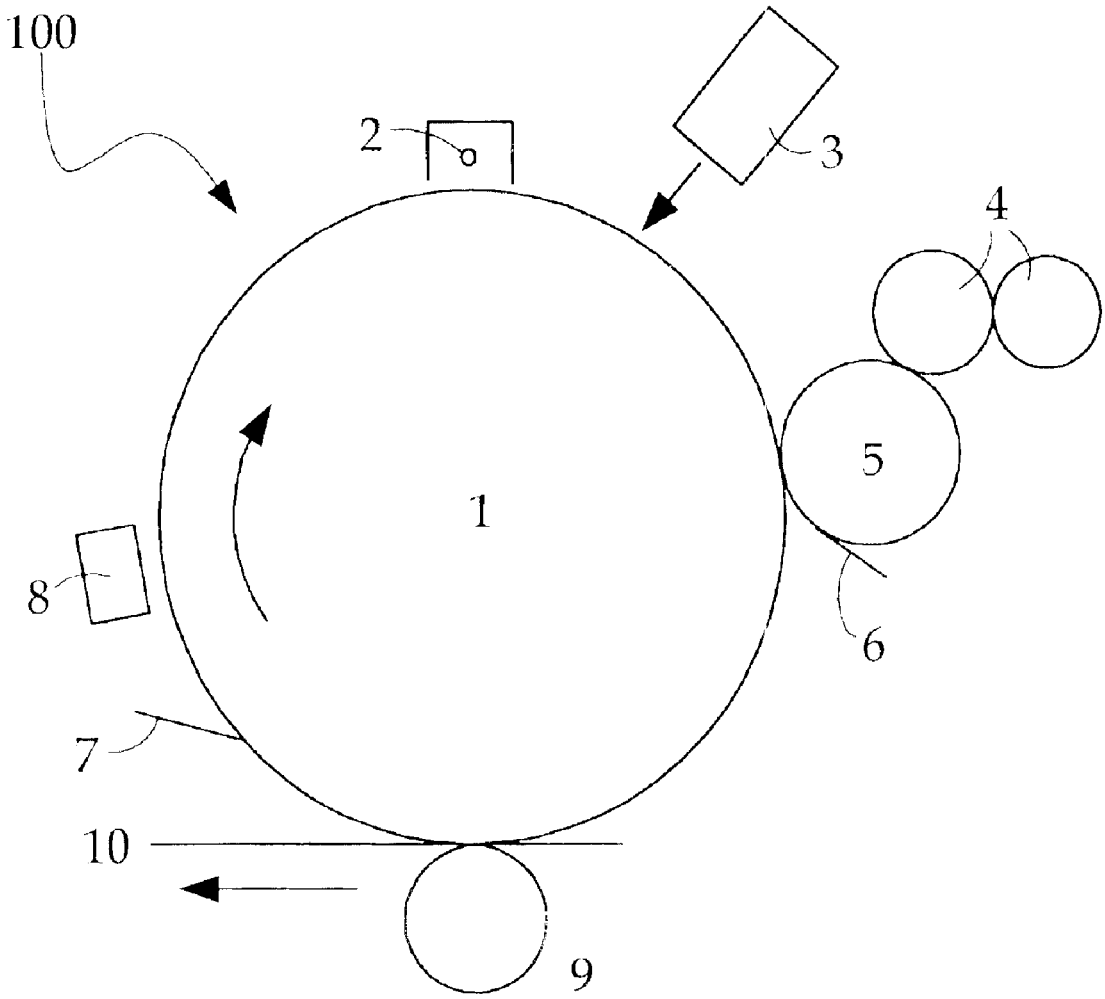
FIG. 1 is a schematic structural diagram of one example of an image forming device 100 suitably used in the present invention.

The liquid developer of the present invention includes an insulating carrier liquid, toner particles, at least one selected from alkoxy-modified silicone and silane coupling agents, and other components appropriately selected as needed.

Insulating Carrier Liquid

The insulating carrier liquid is not particularly limited provided that it is insulating. Suitable examples are all known liquids compounded in liquid developers, such as petroleum-based saturated hydrocarbon compounds, silicone oils, vegetable oils, and the like.

Examples of petroleum-based saturated hydrocarbon compounds are isoparaffin, normal paraffin, and the like.

Examples of silicone oils are dimethyl silicone, methylphenyl silicone, cyclic dimethyl polysiloxane, fluorosilicone, and the like.

Examples of vegetable oils are soybean oil, sunflower oil, rapeseed oil, castor oil, linseed oil, and the like.

A single one of these insulating carrier liquids may be used, or two or more types may be used.

Specific examples of commercially-available insulating carrier compounds include, as petroleum-based saturated hydrocarbon compounds, ISOPAR-G, H, L, M (manufactured by ExxonMobil Chemical Company), NORPAR-12 (manufactured by ExxonMobil Chemical Company), and the like, and as silicone oils, SH-200 series (manufactured by Toray Dow Corning Silicone Co., Ltd.), KF-96 series (manufactured by Shin-Etsu Chemical Co., Ltd.), L-45 series (manufactured by Nihonunica Corporation), AK series (manufactured by Wacker Asahikasei Silicone Co., Ltd.), and the like.

For the purposes of improving dispersability of the toner particles, adjusting the charge of the toner particles, adjusting the viscosity of the liquid developer, and the like, the insulating carrier liquid may contain a metallic soap such a metallic salt of octylic acid, a metallic salt of naphthenic acid, or the like, as well as a known charge adjusting agent such as titanium alkoxide, an aluminum-containing chelating compound, or the like. In addition, the insulating carrier liquid may contain a surfactant such as alkylbenzene sulfonate salt or the like, fatty acid ester compounds and derivatives thereof, solid particulates which are insoluble in the carrier liquid such as silica particulates, alumina particulates, titania particulates, and the like, or the like.

Toner Particles

The toner particles are not particularly limited provided that they are insoluble in the insulating carrier liquid. The toner particles contain a colorant and a binder resin, and contain other components as needed.

Colorant

The colorant is not particularly limited, and examples thereof include known inorganic pigments, organic pigments, dyes, and the like used in liquid developers.

Examples of inorganic pigments are carbon black, red iron oxide, ferrite, magnetite, and the like.

Examples of organic pigments are monoazo red pigments, disazo red pigments, quinacridone magenta pigments, phthalocyanine cyan pigments, anthraquinone blue pigments, and the like.

Examples of dyes include azo dyes, anthraquinone dyes, indigoid dyes, phthalocyanine dyes, methine dyes, quinoline dyes, quinonimine dyes, benzoquinone dyes, and the like.

A single one of these colorants may be used, or two or more types may be used.

The amount of the colorant contained in the toner particles is preferably 1 to 50% by mass.

Binder Resin

The resin composition, the glass transition point, the softening point, the molecular weight and the like of the binder resin are not particularly limited. However, thermoplastic resins which can suitably fix an image onto a transfer material at the time of image formation are preferable.

From the standpoint of a good fusing/fixing characteristic, thermoplastic resins having a low flow tester softening point or a low glass transition point are preferable. Specifically, resins whose flow tester softening point is 140° C. or less are preferable, and resins whose glass transition point is 75° C. or less are more preferable.

Specific examples of binder resins are vinyl chloride resins, vinylidene chloride resins, vinyl acetate resins, epoxy resins, styrene resins, acrylic resins, polyethylene resins, polypropylene resins, fluoride resins, polyamide resins, polyacetal resins, polyester resins, phenol resins, polyurethane resins, rosin and rosin-modified resins, ethylene—vinyl acetate copolymers, ethylene—acrylate copolymers, and the like.

A single one of these binder resins may be used, or two or more types may be used.

Other Components

Examples of other components are internal additives such as waxes, charge controlling agents, magnetic bodies, and the like. Further, when the liquid developer of the present invention is used in a printer using a flash fixing-type system, an infrared absorbent which absorbs light of the infrared region can be suitably used as one of these other components.

The waxes are not particularly limited and may be appropriately selected from among known waxes. Examples include paraffin wax, polyethylene wax, polypropylene wax, polyester wax, alcohol wax, urethane wax, and the like. One type of wax, or two or more types of waxes may be used. Further, the wax may be used by being mixed together with plural types of binder resins.

The charge controlling agent is not particularly limited and may be appropriately selected from among known charge controlling agents. Examples include fluorine surfactants; metal-containing dyes such as salicylic acid metal complexes, azo metal compounds, and the like; tertiary ammonium salts; azine dyes such as nigrosine and the like; and the like. One type or two or more types of charge controlling agents may be used.

The magnetic bodies are not particularly limited and may be appropriately selected from among known magnetic bodies. Examples include metals, alloys, metal compounds, ferrites, and the like.

Examples of metals include iron, cobalt, nickel, and the like. Examples of alloys include alloys of the aforementioned metals, and the like. Examples of metal compounds include $Fe_3O_4$, $\gamma$-$Fe_2O_3$, cobalt-added oxides and the like. Examples of ferrites are MnZn ferrite, NiZn ferrite, and the like. One type or two or more types of these substances may be used.

The infrared absorbent is not particularly limited and may be appropriately selected from among known infrared absorbents. However, infrared absorbents absorbing light of wavelengths of 800 to 1500 nm are suitably used. Specific examples include organic diimonium compounds, naphthalocyanine compounds, aminium compounds, inorganic tin oxide, indium compounds, and the like. A single type of infrared absorbent may be used, or two or more types may be used together. Among these infrared absorbents, doped tin oxide, doped indium oxide, and mixtures thereof are particularly preferable.

The dopant which can suitably dope these metal oxides and the like is not particularly limited, and a suitable dopant can be appropriately selected from among general substances. Specific examples include phosphor, tin, and the like.

The amount of the toner particles contained in the liquid developer is preferably 0.5 to 50% by mass, and more preferably 1 to 30% by mass.

If the content of toner particles is less than 0.5% by mass, the coloring ability is poor, and it may not be possible to obtain a sufficient image density in the printed image. On the other hand, if the content exceeds 50% by mass, the viscosity of the liquid developer increases, and the transportability and drawability of the liquid developer in a printing device are poor, and therefore, it may not be possible to obtain a good printed image.

The average particle diameter (volume average particle diameter) of the toner particles is preferably 0.1 to 10 $\mu$m.

Silane Coupling Agent

The silane coupling agent is not particularly limited provided that it has at least one functional group selected from amino groups, methacryloxy groups, epoxy groups, isocyanate groups, mercapto groups, and vinyl groups, and may be appropriately selected from known silane coupling agents.

If a silane coupling agent having at least one of the aforementioned functional groups is used, there are the advantages that, when the liquid developer is placed in a temperature environment exceeding the glass transition point of the binder resin, the toner particles do not cohere or fuse and a good image can be stably formed. This is thought to be due to the fact that, due to the silane coupling agent being adsorbed at the surface of the toner particles or reacting and binding with the toner particles due to the functional group within the hydrolyzable group or organic group, the silane coupling agent covers the surface of the toner particles, and the toner particles are stabilized within the insulating carrier. Thus, even if the toner particles settle, they can easily be redispersed.

A suitable example of the silane coupling agent is that having the molecular structure shown by following formula 1, where the four functional groups denoted by R, X, Y and Z are at least one selected from organic groups and hydrolyzable groups, and among the four functional groups, at least two are hydrolyzable groups such as methoxy groups or ethoxy groups or the like.

[formula 1]

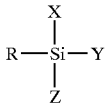

Concrete examples of the silane coupling agent are trimethylmethoxysilane, trimethylethoxysilane, phenyltrimethoxysilane, diphenyltrimethoxysilane, n-decyltrimethoxysilane, vinyltriethoxysilane, vinyltriacetoxysilane, γ-anilinopropyltrimethoxysilane, γ-aminopropyltrimethoxysilane, N-(β-aminoethyl)-γ-aminopropyltrimethoxysilane, N-(β-aminoethyl)-γ-aminopropylmethyldimethoxysilane, γ-mercaptopropyltrimethoxysilane, γ-glycidoxypropyltrimethoxysilane, γ-glycidoxypropylmethyldimethoxysilane, γ-methacryloxypropyltrimethoxysilane, γ-methacryloxypropylmethyldimethoxysilane, perfluorooctylethyltriethoxysilane, and the like. A single one type of these silane coupling agents may be used, or two or more types may be used.

The amount of the silane coupling agent contained in the liquid developer is preferably 0.01 to 10% by mass, and more preferably 0.05 to 5% by mass, with respect to the toner particles.

If the content of the silane coupling agent is less than 0.01% by mass, the effect of suppressing the cohesion and fusion of the toner particles may be insufficient. If the content exceeds 10% by mass, the chargeability of the toner particles may be poor, a deterioration in image quality may arise, and the fixing strength of the printed matter may be insufficient.

Alkoxy-Modified Silicone

The alkoxy-modified silicone is not particularly limited provided that it has one or more alkoxy groups in the molecule, and may be appropriately selected from among known alkoxy-modified silicone. By using an alkoxy-modified silicone in the liquid developer, the same effects as those described above which are obtained by compounding the silane coupling agent can be achieved.

Examples of commercially-available alkoxy-modified silicone are FZ3704 (manufactured by Nihonunica Corporation) and the like.

The contained amount of the alkoxy-modified silicone in the liquid developer is preferably 0.01 to 10% by mass and more preferably 0.1 to 5% by mass with respect to the toner particles.

If the content of the alkoxy-modified silicone is less than 0.01% by mass, the effect of suppressing the cohesion and fusion of the toner particles may be insufficient. If the content exceeds 10% by mass, the chargeability of the toner particles may be poor, a deterioration in image quality may arise, and the fixing strength of the printed matter may be insufficient.

Combined Use of Both Silane Coupling Agent and Alkoxy-Modified Silicone

It is preferable to use both the silane coupling agent and the alkoxy-modified silicone in the liquid developer of the present invention. As compared to using either alone, when both are used, there are the advantages that cohesion and fusion of the toner particles can be effectively suppressed, high-quality images can be obtained even after storage in a high temperature environment or the like, the glass transition point and softening point of the binder resin can be lowered, and the image can be fixed onto a transfer material by using less energy.

Note that, when the silane coupling agent and the alkoxy-modified silicone are both used, the total content of both of these components in the liquid developer is preferably 0.01 to 10% by mass with respect to the toner particles, which is the same as the content in cases in which either of these components is used singly.

The liquid developer of the present invention may be any of a black developer, a magenta developer, a yellow developer, a cyan developer, or the like.

The liquid developer of the present invention is suited to use in various fields, is more suited to image forming methods and image forming devices using an electrophotographic method, and is particularly suited to the image forming device and image forming method for the present invention which will be described later.

The liquid developer of the present invention may be manufactured by using a known method for manufacturing a liquid developer, but, from the standpoints of manufacturing efficiency and the like, is particularly suitably manufactured by the method for manufacturing a liquid developer of the present invention which will be described hereinafter.

In accordance with the liquid developer of the present invention, even if the liquid developer is placed in a temperature environment exceeding the glass transition point of the binder resin, the toner particles do not cohere, fuse or the like, and good images can be formed stably.

Method for Manufacture of Liquid Developer

The method for manufacture of a liquid developer of the present invention includes the process of compounding the insulating carrier liquid, the toner particles, and at least one selected from the alkoxy-modified silicone and the silane coupling agent, and may also include, as needed, other processes which are appropriately selected.

The insulating carrier liquid, the toner particles, the alkoxy-modified silicone and the silane coupling agent are as described above.

The mode of compounding is not particularly limited, and can be selected appropriately in accordance with the object.

However, the following are examples of suitable modes: (1) a mode in which compounding is carried out by adding at least one selected from the alkoxy-modified silicone and the silane coupling agent into the insulating carrier liquid, and thereafter, preparing the toner particles thereat; (2) a mode in which compounding is carried out by preparing the toner particles in the insulating carrier liquid, and thereafter, adding thereto at least one selected from the alkoxy-modified silicone and the silane coupling agent; (3) a mode in which compounding is carried out by adding the silane coupling agent to the insulating carrier liquid and preparing the toner particles thereat, and thereafter, adding the alkoxy-modified silicone; and the like.

In above mode (1), when the silane coupling agent and the alkoxy-modified silicone are both used, after the silane coupling agent is first added into the insulating carrier liquid, when the alkoxy-modified silicone is added, the effect of suppressing the cohesion and fusion of the toner particles is great.

In above mode (2), when the silane coupling agent and the alkoxy-modified silicone are both used, after the silane coupling agent is first added into the insulating carrier liquid, when the alkoxy-modified silicone is added, the effect of suppressing the cohesion and fusion of the toner particles is great.

In above mode (3), when the order of adding the alkoxy-modified silicone and the silane coupling agent is reversed, it may be easy for cohesion and fusing of the toner particles to arise as the temperature of the environment rises.

At the time of compounding, the compounded amounts of the respective components are preferably set such that the contained amounts of the respective components in the obtained liquid developer fall within the preferable numerical ranges of the contained amounts of the respective components stated in the above description of the liquid developer.

The method for preparing the toner particles is not particularly limited, and can be appropriately selected from known methods. Examples include the method disclosed in Japanese Patent Application Laid-Open (JP-A) No. 55-36847 of fabricating toner particles which are adsorbed by a binder resin and a colorant, by mixing together materials such as the binder resin, the colorant, an insulating carrier liquid, and the like by using a ball mill or the like; the method disclosed in JP-A No. 61-180248 of heating materials such as a colorant, a binder resin, an isoparaffin organic liquid, and the like, solvating the binder resin and the organic liquid, and thereafter, lowering the temperature of the solution, and precipitating, as toner particles, the binder resin which contains the colorant; a method for fabricating toner particles by, in a carrier liquid and by using any of various types of grinding/mixing devices such as a bead mill, an attritor or the like, grinding and making into particulates a toner composition in which a colorant and other necessary additives have been kneaded together; and the like.

In a case in which the toner particles are fabricated separately rather than in the insulating carrier liquid, after the toner particles have been added to the insulating carrier liquid, the toner particles and the insulating carrier liquid are mixed together by using a mixer, a bead mill or the like. In this case, the surface of the toner particles may be treated by the silane coupling agent before the toner particles are added into the insulating carrier liquid.

The method for surface treating the toner particles by the silane coupling agent is not particularly limited, and can be selected from among known methods. Examples include a method for adding the toner particles into a water-based medium or alcohol to which the silane coupling agent has been added; a method for spraying a liquid in which the silane coupling agent has been diluted by alcohol or the like, while mixing the toner particles by using a Henschel mixer or the like; and the like.

Image Forming Method and Image Forming Device

The image forming method for the present invention includes at least a step for forming an electrostatic latent image, a step for developing, and a step for transferring. The image forming method preferably further includes a step for fixing, and may, as needed, include other steps which have been appropriately selected, such as step for eliminating charges, a step for cleaning, a step for recycling, a step for controlling, and the like.

The image forming device of the present invention includes at least an electrostatic latent image carrier, means for forming an electrostatic latent image, means for developing and means for transferring. The image forming device preferably further includes a means for fixing, and may, as needed, include other means which have been appropriately selected such as a means for eliminating charges, a means for cleaning, a means for recycling, a means for controlling, and the like.

The image forming method for the present invention can suitably be implemented by the image forming device of the present invention. The step for forming an electrostatic latent image can be carried out by the means for forming an electrostatic latent image, the step for developing can be carried out by the means for developing, the step for transferring can be carried out by the means for transferring, the step for fixing can be carried out by the means for fixing, and the other steps can be carried out by the other means.

Step for Forming Electrostatic Latent Image and Means for Forming Electrostatic Latent Image The step for forming an electrostatic latent image is a step for forming an electrostatic latent image on an electrostatic latent image carrier.

The material, configuration, structure, size and the like of the electrostatic latent image carrier (which hereinafter may be called "photoconductive insulator" or "photoconductor") are not particularly limited, and the electrostatic latent image carrier may be appropriately selected from among known ones. However, drum-shaped is a suitable example of the configuration thereof, and inorganic photosensitive bodies of amorphous silicon, selenium and the like, and organic photosensitive bodies of polysilane, phthalocyanine and the like, and the like are examples of the material thereof.

The electrostatic latent image can be formed, for example, by uniformly charging the surface of the electrostatic latent image carrier, and thereafter, carrying out image-wise exposure. The electrostatic latent image can be formed by the means for forming an electrostatic latent image.

The means for forming an electrostatic latent image includes at least a charging device which uniformly charges the surface of the electrostatic latent image carrier, and an exposure device which image-wise exposes the surface of the electrostatic latent image carrier.

The charging can be carried out by, for example, applying voltage to the surface of the electrostatic latent image carrier by using the charging device.

The charging device is not particularly limited and may be appropriately selected in accordance with the object. Examples of the charging device include known contact-type charging devices equipped with conductive or semiconductive rollers, brushes, films, rubber blades, and the like; non-contact-type charging devices utilizing corona discharge such as a corotron, a scorotron, and the like; and the like.

The exposure can be carried out by, for example, image-wise exposing the surface of the electrostatic latent image carrier by using the exposure device.

Provided that the exposure device can expose the image to be formed on the surface of the electrostatic latent image carrier which has been charged by the charging device, the exposure device is not particularly limited and can be appropriately selected in accordance with the object. Examples include various types of exposure devices such as a reproducing optical system, a rod-lens array system, a laser optical system, a liquid crystal shutter optical system, and the like.

The present invention may use a backlighting system which carries out image-wise exposure from the reverse surface side of the electrostatic latent image carrier.

Step for Developing and Means for Developing

The step for developing is a step for developing the electrostatic latent image with the liquid developer of the present invention, so as to form a visible image.

The formation of the visible image can be carried out by, for example, developing the electrostatic latent image with the liquid developer of the present invention, and can be carried out by the means for developing.

The means for developing has at least a developing device which can accommodate the liquid developer of the present invention, and which can apply, by contact or without contact, the liquid developer to the electrostatic latent image.

The developing device is not particularly limited provided that it is a wet developing method developing device, and may be a developing device for a single color or a developing device for plural colors. An example is a developing device which conveys the liquid developer on the photoconductor by a developing roller, or the like. In this case, the liquid developer may be of a form which can be supplied to the developing roller by developer supplying rollers or the like. In the liquid developer, the toner particles which carry charges are suspended in the insulating carrier liquid. The toner particles move to the surface of the electrostatic latent image carrier (the photoconductor) by electrostatic attraction with the electrostatic latent image. As a result, the electrostatic latent image is developed by the toner particles, and a visible image made visible by the toner particles is formed on the surface of the electrostatic latent image carrier (photoconductor).

In the case of single-color development, generally, black toner is used as the toner particles contained in the liquid developer. In the case of multi-color development, toners of at least two colors selected from black toner, magenta toner, yellow toner, and cyan toner are used. In the case of full-color development, black toner, magenta toner, yellow toner and cyan toner are used.

Step for Transferring and Means for Transferring

The step for transferring is a step for transferring the visible image to a transfer material.

This transfer can be carried out, for example, by utilizing a transfer charging device of a polarity opposite to the polarity of the toner particles contained in the liquid developer of the present invention, or by pressing the toner against the transfer medium by pressure at the time of contact. The transfer can be carried out by the means for transferring. Further, transfer can be carried out by a mode in which transfer is carried out twice, wherein the toner image is transferred from the electrostatic latent image carrier onto a belt-shaped or roller-shaped intermediate transfer medium, and thereafter, is transferred onto a known recording medium (a recording paper or a transfer material).

Examples of the transfer device include a corona transfer device carrying out transfer by corona discharge, a transfer belt, a transfer roller, a pressure-transfer roller, an adhesion transfer device, and the like.

The transfer medium is not particularly limited, and may be appropriately selected from among known recording media (recording papers).

Step for Fixing and Means for Fixing

The step for fixing is a step for fixing, by using a fixing device, the transfer image which has been transferred onto the transfer material.

This fixing may be, for example, fixing by the application of pressure and the application of heat which is carried out by using a heat-fixing roller on the transfer image which has been transferred onto the transfer material. Or, the fixing may be carried out by irradiating light by using a means for flash fixing, such as a flash fixing device or the like, on the transfer image which has been transferred onto the transfer material.

The means for flash fixing may have at least a flash lamp which irradiates infrared light.

The flash lamp is not particularly limited, and may be appropriately selected in accordance with the object. Suitable examples include an infrared ray lamp, a xenon lamp, and the like.

The step for eliminating charges is a step for carrying out charge elimination by exposing the entire surface of the electrostatic latent image carrier or applying a charge-eliminating bias to the electrostatic latent image carrier. The step for eliminating charges can be suitably carried out by a means for eliminating charges.

The means for eliminating charges is not particularly limited, and can be appropriately selected from among known charge eliminating devices, provided that it can expose or can apply a charge-eliminating bias to the electrostatic latent image carrier.

The step for cleaning is a step for removing the electrophotographic toner remaining on the electrostatic latent image carrier, and can be suitably carried out by a means for cleaning.

The means for cleaning is not particularly limited, and can be selected from known cleaners provided that it can remove the wet-type toner for electrophotography remaining on the electrostatic latent image carrier. Suitable examples of the means for cleaning include a magnetic brush cleaner, an electrostatic brush cleaner, a magnetic roller cleaner, a blade cleaner, a brush cleaner, a web cleaner, and the like.

The step for recycling is a step for recycling, to the means for developing, the wet-type toner for electrophotography which has been removed by the step for cleaning, and can be suitably carried out by a means for recycling.

The means for recycling is not particularly limited, and known means for conveying and the like are examples thereof.

The means for controlling is not particularly limited provided that it can control the workings of the above-described respective means, and can be appropriately selected in accordance with the object. Examples include devices such as a sequencer, a computer, and the like.

In the image forming method for the present invention, the electrostatic latent image is formed on the electrostatic latent image carrier in the step for forming an electrostatic latent image. In the step for developing, the electrostatic latent image is developed by the liquid developer of the present invention such that a visible image is formed. In the step for transferring, the visible image is transferred onto a transfer material. In the step for fixing, the transfer image, which has been transferred onto the transfer material, is fixed. As a result, an image is formed and fixed on the transfer material.

In the image forming device of the present invention, the means for forming an electrostatic latent image forms an electrostatic latent image on an electrostatic latent image carrier. The means for developing accommodates the liquid developer of the present invention, and develops the electrostatic latent image so as to form a visible image. The means for transferring transfers the visible image onto a transfer material. The means for fixing fixes the transfer image which has been transferred onto the transfer material. As a result, an image is formed and fixed on the transfer material.

The liquid developer of the present invention is used in the image forming device and the image forming method. Thus, high-quality images can be formed stably over a long period of time.

Hereinafter, the present invention will be described in further detail by using Examples and Comparative Examples. However, the present invention is not in any way limited to the following Examples.

EXAMPLE 1

Preparation of Liquid Developer

70% by mass of an epoxy resin (EPIKOTE 1002, manufactured by Japan Epoxy Resins Co., Ltd.) as the binder resin and a 30% by mass of a cyan pigment (IRGALITE BLUE 8700, manufactured by Chiba Specialty Chemicals Co.) as the colorant were placed in a Henschel mixer and preliminarily mixed together. Thereafter, the mixture was melted and kneaded by an extruder (TCS30 manufactured by Coperion Co.), and then coarse grinding was carried out by a rotoplex grinder such that a coarse toner powder was obtained.

Next, 20.0 g of the obtained coarse toner powder, 1.0 g of an amino silane coupling agent SH6020 (manufactured by Toray Dow Coming Silicone Co.), and 179.0 g of silicone oil SH200-20cs (manufactured by Toray Dow Corning Silicone Co.) were mixed together. The mixture was placed together with zirconia beads in a ceramic pot and stirred for 120 hours so that fine grinding was carried out. A liquid developer containing cyan toner particles whose particle diameter (volume average particle diameter) was 3.1 μm was thereby prepared.

<Evaluation>

Storability Test

Three samples of the obtained liquid developer were left to stand for one day in temperature environments of 50° C., 75° C., and 100° C., respectively. The extent of the cohesion/fusion of the toner particles was measured and evaluated in accordance with the following evaluation standards. The results thereof are shown in Table 1.

◎: rate of increase in particle diameter due to storability test was less than 10%

○: rate of increase in particle diameter due to storability test was 10% or more and less than 20%

Δ: rate of increase in particle diameter due to storability test was 20% or more and less than 50%

X: rate of increase in particle diameter due to storability test was 50% or more, or particles fused such that measurement of the particle diameter was not possible With regard to the cohering and fusing of the toner particles, the particle diameter of the toner particles before and after being left to stand for one day was measured, and the rate of increase in the particle diameter obtained from the following formula was determined.

$$\text{rate of increase in particle diameter (\%)} = (\text{particle diameter after storability test}/\text{particle diameter before storability test} - 1) \times 100$$

Printing Test

The liquid developer before the storability test and the liquid developer after the storability test at 75° were used in an image forming device 100 shown in FIG. 1, and an image was formed as follows to carry out the printing test. Namely, in the image forming device 100 shown in FIG. 1, first, an electrostatic latent image was formed by a charging device 2 and an exposure device 3 on a photoconductor 1 which rotated in the direction of the arrow. By supplying the liquid developer from developer supplying rollers 4 to a developing roller 5, a thin layer of the supplied liquid developer was formed on the developing roller 5 such that a developer layer was formed. Due to the photoconductor 1 rotating further in the direction of the arrow, the electrostatic latent image formed on the photoconductor 1 was made to contact the developer layer formed on the developing roller 5, and a visible image was formed by the toner particles contained in the liquid developer. The formed visible image was transferred onto a recording paper 10 by a pressure-applying roller 9 and was fixed by an unillustrated fixing roller such that a transfer image was formed.

After image formation, the image densities of the image portions and non-image portions of the obtained transfer image were measured by using an image density measuring device (Spectrodensitometer 938 manufactured by X-Rite Co.). The results are shown in Table 1.

EXAMPLE 2

A liquid developer containing cyan toner particles having a particle diameter (volume average particle diameter) of 3.3 μm was prepared in the same way as in Example 1, except that the amino silane coupling agent was replaced by amino silane coupling agent KBM903 (manufactured by Shin-Etsu Chemical Co., Ltd.). The same evaluations as those in Example 1 were carried out, and the results are shown in Table 1.

EXAMPLE 3

A liquid developer containing cyan toner particles having a particle diameter (volume average particle diameter) of 3.3 μm was prepared in the same way as in Example 1, except that the amino silane coupling agent was replaced by anilino silane coupling agent SZ6083 (manufactured by Toray Dow Corning Silicone Co., Ltd.). The same evaluations as those in Example 1 were carried out, and the results are shown in Table 1.

EXAMPLE 4

A liquid developer containing cyan toner particles having a particle diameter (volume average particle diameter) of 3.6 μm was prepared in the same way as in Example 1, except that the amino silane coupling agent was replaced by glycidoxy silane coupling agent SH6040 (manufactured by Toray Dow Corning Silicone Co., Ltd.). The same evaluations as those in Example 1 were carried out, and the results are shown in Table 1.

EXAMPLE 5

A liquid developer containing cyan toner particles having a particle diameter (volume average particle diameter) of 3.5

μm was prepared in the same way as in Example 1, except that the amino silane coupling agent was replaced by methacryloxy silane coupling agent SZ6030 (manufactured by Toray Dow Corning Silicone Co., Ltd.). The same evaluations as those in Example 1 were carried out, and the results are shown in Table 1.

EXAMPLE 6

A liquid developer containing cyan toner particles having a particle diameter (volume average particle diameter) of 3.6 μm was prepared in the same way as in Example 1, except that the amino silane coupling agent was replaced by isocyanate silane coupling agent Y-5187 (manufactured by Nihonunica Corporation). The same evaluations as those in Example 1 were carried out, and the results are shown in Table 1.

EXAMPLE 7

A liquid developer containing cyan toner particles having a particle diameter (volume average particle diameter) of 3.2 μm was prepared in the same way as in Example 1, except that the amino silane coupling agent was replaced by mercapto silane coupling agent A-189 (manufactured by Nihonunica Corporation). The same evaluations as those in Example 1 were carried out, and the results are shown in Table 1.

EXAMPLE 8

A liquid developer containing cyan toner particles having a particle diameter (volume average particle diameter) of 3.5 μm was prepared in the same way as in Example 1, except that the amino silane coupling agent was replaced by vinyl silane coupling agent SZ6300 (manufactured by Toray Dow Corning Silicone Co., Ltd.). The same evaluations as those in Example 1 were carried out, and the results are shown in Table 1.

EXAMPLE 9

A liquid developer containing cyan toner particles having a particle diameter (volume average particle diameter) of 3.2 μm was prepared in the same way as in Example 1, except that the amino silane coupling agent was replaced by methyl silane coupling agent AY43-043 (manufactured by Toray Dow Corning Silicone Co., Ltd.). The same evaluations as those in Example 1 were carried out, and the results are shown in Table 1.

EXAMPLE 10

A liquid developer containing cyan toner particles having a particle diameter (volume average particle diameter) of 3.6 μm was prepared in the same way as in Example 1, except that the amino silane coupling agent was replaced by n-decyl silane coupling agent AY43-210MC (manufactured by Toray Dow Corning Silicone Co., Ltd.). The same evaluations as those in Example 1 were carried out, and the results are shown in Table 1.

EXAMPLE 11

A liquid developer containing cyan toner particles having a particle diameter (volume average particle diameter) of 2.9 μm was prepared in the same way as in Example 1, except that the amino silane coupling agent was replaced by amino silane coupling agent KBM903 (manufactured by Shin-Etsu Chemical Co., Ltd.), and the silicone oil was replaced by ISOPAR-L (manufactured by ExxonMobil Chemical Company). The same evaluations as those in Example 1 were carried out, and the results are shown in Table 1.

COMPARATIVE EXAMPLE 1

A liquid developer containing cyan toner particles having a particle diameter (volume average particle diameter) of 5.9 μm was prepared in the same way as in Example 1, except that the compounded amount of the toner composition coarse powder was changed to 50.0 g, the compounded amount of the silicone oil was changed to 450.0 g, and no amino silane coupling agent was compounded. The same evaluations as those in Example 1 were carried out, and the results are shown in Table 1.

EXAMPLE 12

A liquid developer containing cyan toner particles having a particle diameter (volume average particle diameter) of 3.3 μm was prepared in the same way as in Example 1, except that 1.0 g of the amino silane coupling agent was changed to 2.0 g of alkoxy-modified silicone FZ3704 (manufactured by Nihonunica Corporation), and 179.0 g of silicone oil was changed to 178.0 g of silicone oil. The same evaluations as those in Example 1 were carried out, and the results are shown in Table 1.

EXAMPLE 13

Preparation of Liquid Developer

A toner composition was prepared by dissolving 100 g of the coarse toner powder obtained in Example 1 in 400 g of n-butyl acetate (manufactured by Wako Pure Chemicals Industries, Ltd.). Thereafter, 468 g of this toner composition was placed in 4500 mL of an ion-exchanged water in which 0.05% by mass of sodium dodecylbenzenesulfonate (manufactured by Wako Pure Chemicals Industries, Ltd.) was dissolved. High speed stirring was carried out for 10 minutes at 12,000 rpm by using Clearmix (manufactured by M Technique Co., Ltd.). While stirring slowly, the pressure was reduced by using a vacuum pump, the n-butyl acetate was distilled, and a water dispersion liquid of toner particles was obtained. 1.0 g of amino silane coupling agent SH6020 (manufactured by Toray Dow Corning Silicone Co., Ltd.) was added to this water dispersion liquid. The mixture was stirred for 8 hours at 40° C., and thereafter was filtered and dried. Surface-treated toner particles were prepared by carrying out surface treatment by the amino silane coupling agent.

20.0 g of the surface-treated toner particles, 2.0 g of alkoxy-modified silicone FZ3704 (manufactured by Nihonunica Corporation), and 180.0 g of silicone oil SH200-20cs (manufactured by Toray Dow Corning Silicone Co., Ltd.) were mixed together and placed in a ceramic pot together with zirconia beads. Stirring was carried out for 120 hours such that the toner particles were ground more finely, and a liquid developer containing cyan toner particles having a particle diameter (volume average particle diameter) of 2.5 μm was prepared. The same evaluations as those in Example 1 were carried out on this liquid developer, and the results are shown in Table 1.

EXAMPLE 14

A liquid developer containing cyan toner particles having a particle diameter (volume average particle diameter) of 3.4 μm was prepared by, after obtaining the cyan liquid developer in Example 1, further adding 0.5 g of alkoxy-modified silicone FZ3704 (manufactured by Nihonunica Corporation)

and stirring for 6 hours. The same evaluations as those in Example 1 were carried out, and the results are shown in Table 1.

EXAMPLE 15

Preparation of Liquid Developer 20.0 g of the coarse toner powder obtained in Example 1, 0.5 g of alkoxy-modified silicone FZ3704 (manufactured by Nihonunica Corporation), and 178.5 g of silicone oil SH200-20cs (manufactured by Toray Dow Corning Silicone Co., Ltd.) were mixed together and placed in a ceramic pot together with zirconia beads. Stirring was carried out for 120 hours such that the toner powder was ground more finely. 1.0 g of amino silane coupling agent SH6020 (manufactured by Toray Dow Corning Silicone Co., Ltd.) was further added, stirring was carried out for 6 hours, and a liquid developer containing cyan toner particles having a particle diameter (volume average particle diameter) of 3.6 μm was prepared. The same evaluations as those in Example 1 were carried out on this liquid developer, and the results are shown in Table 1.

EXAMPLE 16

20.0 g of the coarse toner powder obtained in Example 1, 1.0 g of amino silane coupling agent SH6020 (manufactured by Toray Dow Corning Silicone Co., Ltd.), 0.5 g of alkoxy-modified silicone FZ3704 (manufactured by Nihonunica Corporation), and 178.5 g of silicone oil SH200-20cs (manufactured by Toray Dow Corning Silicone Co., Ltd.) were mixed together and placed in a ceramic pot together with zirconia beads. Stirring was carried out for 120 hours such that the toner powder was ground more finely, and a liquid developer containing cyan toner particles having a particle diameter (volume average particle diameter) of 2.8 μm was prepared. The same evaluations as those in Example 1 were carried out, and the results are shown in Table 1.

The present invention provides a liquid developer which has good storage stability and can enable formation of high-quality images stably over a long period of time, and an effective method for manufacturing the liquid developer, and an image forming device and image forming method.

What is claimed is:

1. A liquid developer comprising:

an insulating carrier liquid;

toner particles containing a colorant and a binder resin, and insoluble in the insulating carrier liquid; and at least one selected from alkoxy-modified silicone and silane coupling agents having at least one functional group selected from amino groups, methacryloxy groups, epoxy groups, isocyanate groups, mercapto groups, and vinyl groups.

2. A liquid developer according to claim 1, wherein the insulating carrier liquid is at least one selected from aliphatic hydrocarbons and silicone oils.

3. A liquid developer according to claim 1, wherein a contained amount of the toner particles is 0.5 to 50% by mass.

4. A liquid developer according to claim 1, wherein a volume average particle diameter of the toner particles is 0.1 to 10 μm.

5. A liquid developer according to claim 1, wherein a volume average particle diameter of the toner particles is 0.1 to 5 μm.

6. A liquid developer according to claim 1, wherein a content of the at least one selected from alkoxy-modified silicone and silane coupling agents is 0.01 to 10% by mass with respect to the toner particles.

7. A method for manufacturing a liquid developer comprising a step for compounding:

an insulating carrier liquid;

toner particles containing a colorant and a binder resin, and insoluble in the insulating carrier liquid; and

TABLE 1

| examples and comparative examples | toner particle diameter (μm) | printed image (using developer before stor-ability test) image density | change in particle diameter in storability test 50° C. | 75° C. | 100° C. | printed image (using developer after stor-ability test at 75° C.) image density |
|---|---|---|---|---|---|---|
| ex. 1 | 3.1 | 1.45 | ◎ | ◎ | ○ | 1.43 |
| ex. 2 | 3.3 | 1.43 | ◎ | ◎ | ○ | 1.40 |
| ex. 3 | 3.3 | 1.44 | ◎ | Δ | Δ | 1.15 |
| ex. 4 | 3.6 | 1.40 | ◎ | Δ | Δ | 1.20 |
| ex. 5 | 3.5 | 1.42 | ◎ | ○ | Δ | 1.36 |
| ex. 6 | 3.6 | 1.32 | ◎ | ○ | Δ | 1.39 |
| ex. 7 | 3.2 | 1.40 | ◎ | ○ | Δ | 1.32 |
| ex. 8 | 3.5 | 1.42 | ◎ | Δ | Δ | 1.01 |
| ex. 9 | 3.2 | 1.33 | ○ | Δ | Δ | 0.98 |
| ex. 10 | 3.6 | 1.30 | ○ | Δ | Δ | 1.12 |
| ex. 11 | 2.9 | 1.42 | ◎ | Δ | Δ | 1.23 |
| comp. ex. 1 | 5.9 | 1.03 | X | X | X | measurement not possible due to fusion |
| ex. 12 | 3.3 | 1.38 | ◎ | ○ | Δ | 1.36 |
| ex. 13 | 2.5 | 1.45 | ◎ | ◎ | ◎ | 1.42 |
| ex. 14 | 3.4 | 1.39 | ◎ | ◎ | ◎ | 1.36 |
| ex. 15 | 3.6 | 1.40 | ◎ | ○ | Δ | 1.41 |
| ex. 16 | 2.8 | 1.35 | ◎ | ◎ | ◎ | 1.34 |

at least one selected from alkoxy-modified silicone and silane coupling agents having at least one functional group selected from amino groups, methacryloxy groups, epoxy groups, isocyanate groups, mercapto groups, and vinyl groups.

8. A method for manufacturing a liquid developer comprising a step for preparing toner particles after adding at least one selected from alkoxy-modified silicone and silane coupling agents to an insulating carrier liquid.

9. A method for manufacturing a liquid developer comprising a step for adding at least one selected from alkoxy-modified silicone and silane coupling agents to toner particles in an insulating carrier liquid after preparing the toner particles.

10. A method for manufacturing a liquid developer comprising:

a step for adding silane coupling agents to an insulating carrier liquid;

a step for preparing toner particles in the insulating carrier liquid; and a step for adding an alkoxy-modified silicone in the insulating carrier liquid.

11. A liquid developer manufactured by a method for manufacturing a liquid developer comprising a step for compounding:

an insulating carrier liquid;

toner particles containing a colorant and a binder resin, and insoluble in the insulating carrier liquid; and at least one selected from alkoxy-modified silicone and silane coupling agents having at least one functional group selected from amino groups, methacryloxy groups, epoxy groups, isocyanate groups, mercapto groups, and vinyl groups.

12. An image forming method comprising:

a step for forming an electrostatic latent image on an electrostatic latent image carrier;

a step for developing the electrostatic latent image with a liquid developer, and forming a visible image; and a step for transferring the visible image onto a transfer material, wherein the liquid developer comprises:

an insulating carrier liquid, toner particles containing a colorant and a binder resin, and insoluble in the insulating carrier liquid; and at least one selected from alkoxy-modified silicone and silane coupling agents having at least one functional group selected from amino groups, methacryloxy groups, epoxy groups, isocyanate groups, mercapto groups, and vinyl groups.

13. An image forming device comprising:

an electrostatic latent image carrier;

means for forming an electrostatic latent image on the electrostatic latent image carrier;

means for developing the electrostatic latent image with a liquid developer, forming a visible image, and which accommodates the liquid developer; and means for transferring the visible image onto a transfer material, wherein the liquid developer comprises:

an insulating carrier liquid;

toner particles containing a colorant and a binder resin, and insoluble in the insulating carrier liquid; and at least one selected from alkoxy-modified silicone and silane coupling agents having at least one functional group selected from amino groups, methacryloxy groups, epoxy groups, isocyanate groups, mercapto groups, and vinyl groups.

* * * * *